United States Patent [19]

Patterson

[11] Patent Number: 4,525,933

[45] Date of Patent: Jul. 2, 1985

[54] ADJUSTABLE T-SQUARE

[76] Inventor: Richard M. Patterson, P.O. Box 567, Hendersonville, N.C. 28793

[21] Appl. No.: 483,736

[22] Filed: Apr. 11, 1983

[51] Int. Cl.[3] ..... B43L 7/06

[52] U.S. Cl. ..... 33/470

[58] Field of Search ..... 33/470, 479, 452, 468, 33/469, 471, 495, 500, 472, 473, 465; 403/346, 347, 387, 388

[56] References Cited

U.S. PATENT DOCUMENTS

| | | | |
|---|---|---|---|
| 460,421 | 9/1891 | Allen | 33/470 |
| 500,570 | 7/1893 | Gates | 33/470 |
| 506,416 | 10/1893 | Colley | 33/470 |
| 714,404 | 10/1902 | Schaller | 33/468 |
| 905,249 | 12/1908 | Townsend | 33/470 |
| 1,268,711 | 6/1918 | Griffiths | 33/469 |
| 1,295,180 | 2/1919 | Lowenstein | 33/470 |
| 1,606,192 | 11/1926 | Sisson | 33/470 |
| 1,633,903 | 6/1927 | Perrin | 33/470 |
| 1,807,438 | 5/1931 | Ross | 33/470 |
| 2,104,515 | 1/1938 | Golden | 33/479 |
| 2,179,658 | 11/1939 | Gallagher | 33/452 |
| 2,269,841 | 1/1942 | Blair | 33/470 |
| 2,435,329 | 2/1948 | Brockley | 33/468 |
| 2,545,112 | 3/1951 | Sheridan | 33/468 |
| 2,812,582 | 10/1957 | Achbach | 33/495 |
| 3,273,246 | 9/1966 | Siberini | 33/470 |
| 4,312,133 | 1/1982 | Mima | 33/468 |

*Primary Examiner*—Charles Frankfort
*Assistant Examiner*—Patrick R. Scanlon
*Attorney, Agent, or Firm*—Roylance, Abrams, Berdo & Goodman

[57] ABSTRACT

An adjustable T-square comprising an elongated blade with measuring indicia on its top surface and an elongated cross member having angular measurement indicia on its top surface. The blade and cross member are coupled together to provide precise relative perpendicular positioning, relative movement of the cross member along the longitudinal axis of the blade while maintaining the perpendicular relationship, and relative angular adjustment. The perpendicular orientation between the cross member and blade is provided by a notch within the top surface of the cross member which receives the blade. A threaded member and knob are employed for attaching the cross member and blade to permit relative positioning angularly and linearly while coupled, and to secure the blade and cross member in a desired position.

5 Claims, 11 Drawing Figures

ADJUSTABLE T-SQUARE

FIELD OF THE INVENTION

The present invention relates to an adjustable T-square having an elongated blade and an elongated cross member, which cross member can be secured to the blade at various positions along the length of the blade and at various angles relative to the longitudinal axis of the blade. The adjustable T-square is particularly useful as a tool for the construction industry, particularly for cutting wall board.

BACKGROUND OF THE INVENTION

In the construction industry, a tool in the form of an adjustable T-square is desirable, particularly for cutting wall board. Such a T-square should have a blade and cross member with the cross member being easily adjustable to various angular positions and various positions along the longitudinal axis of the blade. This adjustment facilitates making angular cuts in the wall board and locating openings in the wall board for devices such as electrical outlets and switches.

Conventional adjustable T-squares, for the most part, are intended merely as drafting instruments. These drafting instruments are not adaptable or easily usable in forming large tools suitable for use in the construction industry.

For example, U.S. Pat. No. 3,273,246 to Siberini discloses an adjustable T-square having a blade and a cross member coupled for longitudinal and angular adjustment. A thumb screw passes through a longitudinal slot within the blade and is engaged in a threaded aperture within the cross member. The blade is received on one surface of the cross member to permit angular adjustment and on the opposite surface to permit longitudinal adjustment. For longitudinal adjustment, the blade and head are coupled by a dovetail arrangement requiring the thumb screw to be completely removed and the blade to be axially removed from the cross member notch to change from the sliding motion with the cross member maintaining a perpendicular relationship relative to the blade to the angularly adjustable position. The Siberini T-square requires the head member to be located in only one position along the longitudinal length of the blade to permit use of its angular indicia.

In another example, U.S. Pat. No. 905,249 to Townsend discloses an adjustable T-square having two threaded members. Each of these threaded members must be adjusted to vary the angular and/or longitudinal position of the cross member.

U.S. Pat. No. 2,435,529 to Brockley and U.S. Pat. No. 2,545,112 to Sheridan disclose adjustable T-squares having pin and hole arrangements for angularly adjusting a cross member relative to its blade.

U.S. Pat. No. 506,416 to Colley discloses an adjustable T-square having a cross member with a notch receiving its blade. When the blade is received within the notch it is maintained perpendicular relative to the blade. Angular adjustment is permitted by removing the blade from the notch and pivoting the blade relative to the cross member to the desired angle. A threaded connection locks the blade within the notch or secures the blade against the back surface of the cross member to maintain the blade and cross member at the desired angle. However, the cross member cannot be located in an adjusted position the length of the blade by the threaded connector.

SUMMARY OF THE INVENTION

Accordingly, a primary object of the present invention is to provide an adjustable T-square by which the longitudinal and angular positions of the blade and cross member can be easily and accurately adjusted.

Another object of the present invention is to provide an adjustable T-square of rugged construction which is simple and inexpensive to manufacture.

The foregoing objects are basically attained by an adjustable T-square comprising an elongated blade and an elongated cross member coupled to the blade. The elongated blade has a longitudinal axis and linear measurement indicia on one of its surfaces. The elongated cross member also has a longitudinal axis, and has top and bottom surfaces with angular measurement indicia on its top surface. The coupling between the blade and cross member comprises orienting means and attaching means. The orienting means locates the blade perpendicular to the cross member and prevents angular movement therebetween, permitting the cross member to slide along the blade's longitudinal axis. For pivoting the cross member to vary its angular position relative to the blade, the orienting means is disengaged. The attaching means is movable between various positions for controlling disengagement of the orienting means and for securing the cross member to the blade in a desired longitudinal and angular position. In a first position, the attaching means maintains engagement of the orienting means and prevents movement of the cross member along the blade's longitudinal axis. In the second position, the attaching means maintains engagement of the orienting means and permits movement of the cross member along the blade's longitudinal axis. In the third position, the attaching means permits disengagement of the orienting means and permits movement of the cross member angularly and longitudinally relative to the blade's longitudinal axis. Finally, in the fourth position, the attaching means secures the blade and cross member in a desired longitudinal and angular position when the orienting means is disengaged.

By forming the adjustable T-square in this manner, the cross member may be simply and quickly adjusted to any position along the longitudinal axis and angularly relative to the longitudinal axis of the blade. Such adjustment can be accomplished by varying the position of the attaching means, engaging or disengaging the orienting means, and positioning the blade and cross member to the desired position. Once the blade and cross member are relatively positioned in a desired manner, the attaching means is moved to the appropriate position to secure them in place.

The orienting means can comprise a notch with a land. The attaching means can comprise a threaded fastener coupled to the land and extending through an elongated slot within the blade. The side surfaces of the notch engage the sides of the blade and the sides of the slot engage the land to prevent the cross member from pivoting relative to the blade, while permitting the blade to slide within the notch. The blade can be lifted out of the notch and pivoted across the top surface of the cross member without disengagement of the attaching means permitting rapid angular adjustment of the cross member relative to the blade.

Other objects, advantages and salient features of the present invention will become apparent from the following detailed description which, taken in conjunction with the annexed drawings, discloses a preferred embodiment of the present invention.

As used in this application, the terms "top", "bottom" and "side" are intended to facilitate the description of the T-square. Thus, such terms are merely illustrative of the T-square and are not intended to limit the T-square to any specific orientation.

BRIEF DESCRIPTION OF THE DRAWINGS

Referring to the drawings which form a part of this original disclosure.

DETAILED DESCRIPTION OF THE PREFERRED EMBODIMENT OF THE INVENTION

Figure 1:
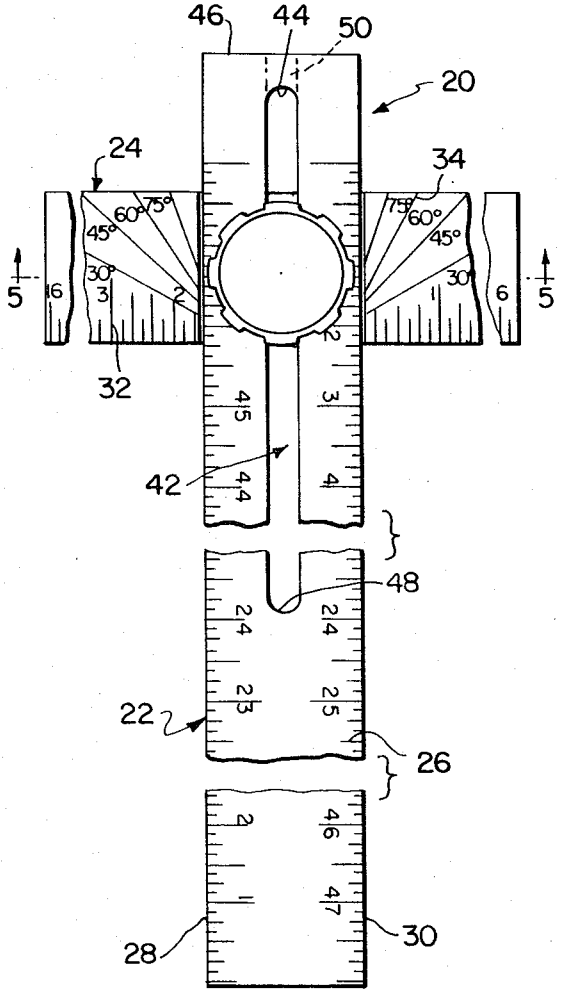
FIG. 1 is a partial, top plan view of an adjustable T-square in accordance with the present invention with the cross member located at a right angle relative to the blade.
Figure 11:
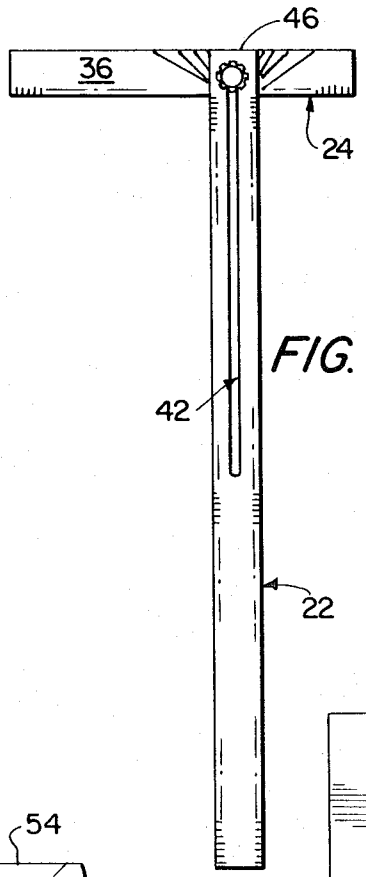
FIG. 11 is a full top plan of an adjustable T-square in accordance with the present invention.

Referring initially to FIGS. 1 and 11, the adjustable T-square 20 of the present invention comprises an elongated blade 22 and an elongated cross member 24. Blade 22 has linear measurement indicia 26 along its opposite longitudinal top side edges 28, 30. Cross member 24 has both linear measurement indicia 32 and angle measurement indicia 34 on its top surface 36. Linear indicia 32 is located along one of the longitudinal side edges of cross member 24.

Figure 8:
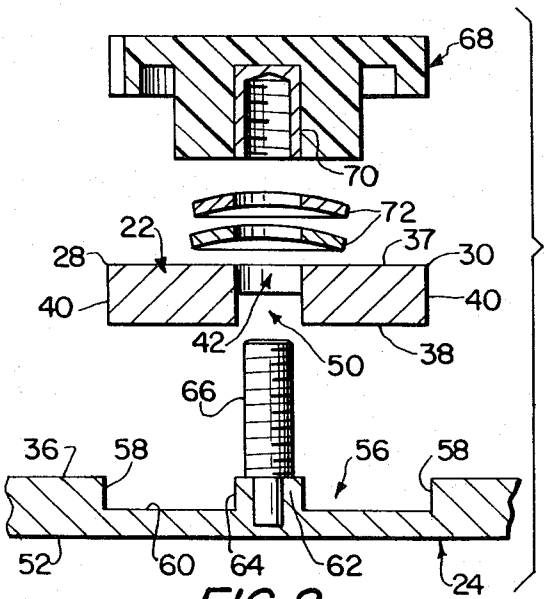
FIG. 8 is an exploded, partial, side elevational view of the T-square of FIG. 1, in cross section.
Figure 5:
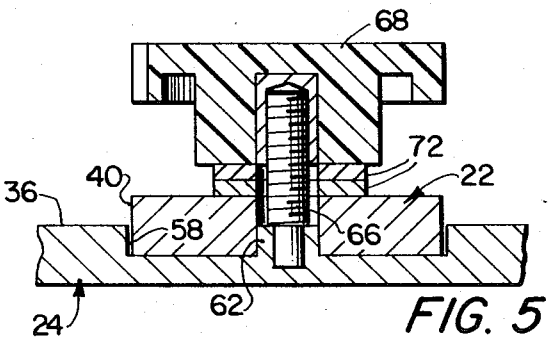
FIG. 5 is an enlarged, side elevational view in section taken along lines 5—5 of FIG. 1.

As illustrated in FIGS. 1, 5 and 8, the blade member has a top surface 37, a bottom surface 38 and side walls 40 which define a rectangle in both transverse and longitudinal cross section. Linear indicia 26 is located on blade top surface 37. An elongated through slot 42 extends from top surface 37 to bottom surface 38 for approximately one-half the longitudinal length of the blade. One end 44 of slot 42 terminates adjacent end 46 of blade 22. The opposite end of the slot terminates at an end 48 located substantially at the 24 inch or half-way mark of linear indicia 26. The side walls of slot 42 are parallel to side walls 40 of the blade. The linear indicia on the blade starts at a location spaced from end 46 substantially equal to the width of cross member 24.

Figure 10:
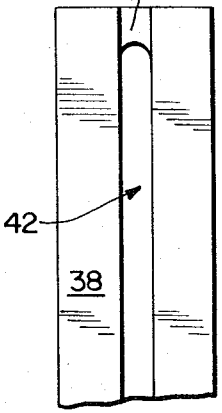
FIG. 10 is a partial, bottom plan view of the blade of the adjustable T-square of FIG. 1.

As illustrated in FIG. 10, a recess 50 is provided on bottom surface 38 of the blade. The recess opens on the bottom surface and at its opposite longitudinal ends on blade end 46 and end 44 of slot 42. In transverse cross section, the recess is rectangular.

Figure 9:
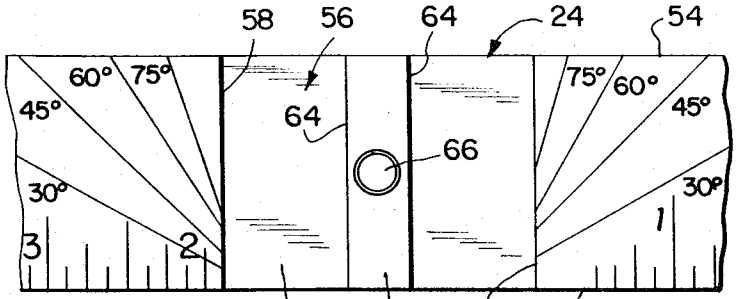
FIG. 9 is an enlarged, partial top plan view of the cross member of the adjustable T-square of FIG. 1.

Referring particularly to FIGS. 8 and 9, cross member 24 has planar bottom and top surfaces 36, 52 and side edges 54. In transverse cross section, the side edges and top and bottom surfaces of the cross member define a rectangle, equal in size to the cross sectional dimensions of the blade.

A notch 56 is formed in top surface 36 and extends inwardly for approximately one-half the thickness of cross member 24. The notch is defined by substantially parallel and planar side surfaces 58 and a base surface 60 extending between the side surfaces. Side surfaces 58 are perpendicular to top surface 36 and to the longitudinal axis of the cross member. The base surface 60 is parallel to and spaced between the top and bottom surfaces of the cross member. With the blade received within the notch, the notch and the blade side walls 40 provide orienting means perpendicularly locating the blade and cross member.

A rectangular land 62 extends from base surface 60 within notch 56. The land has planar side walls 64 extending parallel to side surfaces 58 of the notch. The land extends across the entire width of the notch and is substantially equal in length with the notch side surfaces.

An externally threaded rod 66 is fixedly mounted within land 62 in any suitable manner, e.g., welding or threading. The threaded rod extends upwardly from the land in a direction perpendicular to cross member top surface 36 and the longitudinal axis of the cross member, and is located at a point approximately one-half the distance across the width of the cross member. The transverse cross sectional dimensions of threaded rod 66 is less than the spacing between land side walls 64 such that the lateral extent of the threaded rod is entirely within the periphery of land 62.

A knob 68 receives an internally threaded insert 70 which threadedly engages threaded rod 66. Preferably, knob 68 is formed of plastic while insert 70 is metallic. A pair of bevelled spring washers 72 can be provided on threaded rod 66 between knob 68 and blade top surface 37. Threaded rod 66 and knob 68, as well as blade slot 42, provide attaching means for the blade and cross member.

The T-square is assembled with the cross member located perpendicularly relative to the blade, as illustrated in FIGS. 1 and 5, by locating the blade within notch 56. Since blade side walls 40 are spaced closer than notch side surfaces 58, blade 22 is easily received within the notch. Threaded rod 66 passes through slot 42 as land 62 is received within the blade slot. Thereafter, washer 72 and knob 68 are coupled to threaded rod 66 to secure the blade to the cross member. When the cross member is located at blade end 46 as illustrated in FIG. 11, a portion of land 62 will be received within recess 50.

With blade 22 located within notch 56 of cross member 24 and the nut slightly unthreaded from the position illustrated in FIG. 5, the cross member can be easily slid along the longitudinal axis of the blade for the length of slot 42, while being maintained precisely perpendicular to the blade longitudinal axis. Relative angular movement from the perpendicular orientation is prevented by engagement of blade side walls 40 and notch side surfaces 58. Engagement of land side walls 64 and the side edges of slot 42 and/or recess 50 further inhibit angular movement of the cross member from the perpendicular orientation. Since the side edges of slot 42 are maintained at a distance from threaded rod 66 by the engagement of the land side walls and the slot side edges, damage to the threads of rods 66 is prevented. Upon tightening of knob 68 against washers 72 and thereby against the top surface 37 of blade 22, the blade and cross member are fixed in a predetermined longitudinal position by the frictional engagement therebetween.

Angle indicia 34 comprise lines which cooperate with one of the side edges 28, 30 of blade 22. In this manner, angle indicia 34 can be employed to determine the relative angle between the cross member and blade at any position of the cross member along the length of slot 42.

Figure 2:
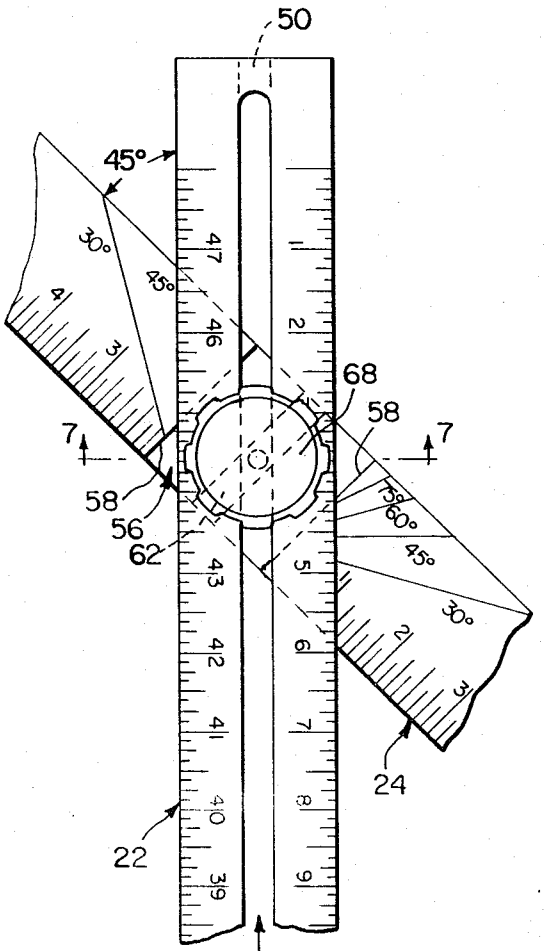
FIG. 2 is a partial, top plan view illustrating the adjustable T-square of FIG. 1 with the cross member and blade at an acute angle.
Figure 6:
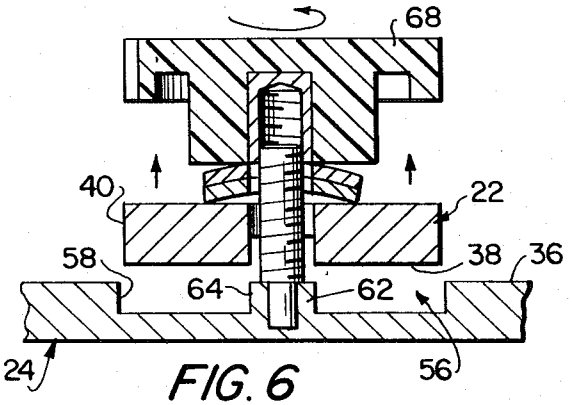
FIG. 6 is a partial, side elevational view in section of the adjustable T-square of FIG. 1 positioned to permit angular adjustment of the blade and cross member.
Figure 7:
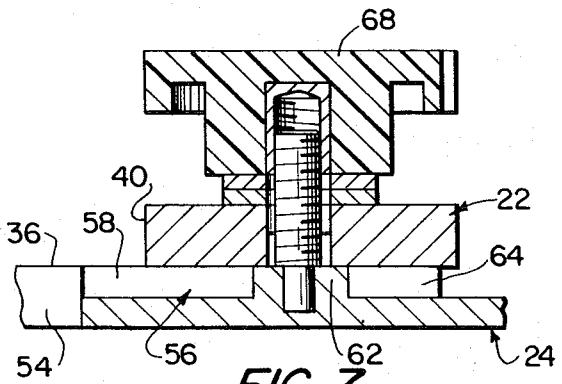
FIG. 7 is an enlarged, partial side elevational view taken along lines 7—7 of FIG. 2.

To adjust cross member 24 to an angular position relative to blade 22, other than the perpendicular orientation illustrated in FIG. 1, knob 68 is unthreaded, as illustrated in FIG. 6, to an extent permitting blade 22 to be removed from notch 56 and spaced slightly above cross member top surface 36. Since knob 68 is not completely removed from threaded rod 66, the blade and cross member remain connected throughout the angular and/or longitudinal adjustment. Once the blade is lifted out of notch 56, the blade is free to pivot about rod 66 relative to the cross member as illustrated in FIGS. 2 and 7. The blade will not damage the threads on rod 66 in this position since slot 42 is wider than the rod.

Once the cross member is located at the desired angle relative to the blade, the knob is again tightened against the blade top surface forcing it against the cross member. Such tightening causes blade bottom surface 38 to engage cross member top surface 36 and the top surface of land 62, which is coplanar with the cross member top surface, providing a frictional engagement securing the blade and cross member in the desired relative position. The engagement of the blade bottom surface with the land top surface prevents the blade from buckling across the notch and enhances the frictional engagement between the blade and cross member.

Figure 4:
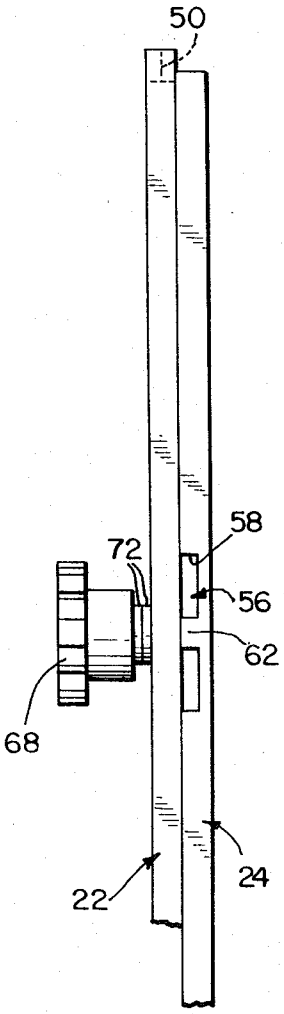
FIG. 4 is a partial, side elevational view of the adjustable T-square of FIG. 3.
Figure 3:
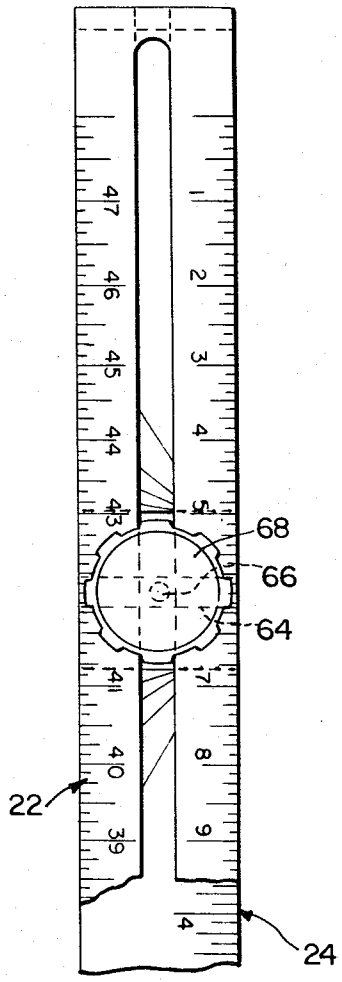
FIG. 3 is a partial, top plan view of the adjustable T-square of FIG. 1 located in a storage position.

To facilitate storage of adjustable T-square 20 in minimum space, the longitudinal axes of the blade and cross member can be oriented parallel to each other as illustrated in FIGS. 3 and 4. The coupling of the blade and cross member will be essentially the same as that discussed above in connection with the non-perpendicular angular relationship of the blade and cross member. With the blade and cross member in the stored position, no portion of the device extends laterally beyond the side edges 28, 30 of blade 22.

Cross member 24 can be located in any desired longitudinal position along the length of slot 42 and at any desired angular relationship relative to blade 22 merely by loosening knob 68 and moving the blade and cross member to their desired positions. Since the two parts always remain coupled during the adjustment, loss or misalignment of the parts is prevented. The parts are simply and quickly secured in the desired position by merely retightening the knob on the threaded member.

In lieu of the attaching arrangement illustrated, knob 68 could be fixed to threaded rod 66. In this alternative arrangement, an internally threaded aperture could be provided within land 62 which would threadedly receive the threaded rod. The position of the knob would be adjusted by threading and unthreading the threaded rod within the threaded aperture.

Additionally, suitable flanges or extensions can extend from the bottom surface 52 of cross member 24 adjacent the edge bearing linear indicia 32. Such flange or extension enhances the engagement of the cross member with a bevelled or flat edge of a piece of wall board.

While a particular embodiment has been chosen to illustrate the invention, it will be understood by those skilled in the art that various changes and modifications can be made therein without departing from the scope of the invention as defined in the appended claims.

What is claimed is:

1. An adjustable T-square, comprising:

an elongated blade having a longitudinal axis, top and bottom surfaces, side walls, linear measurement indicia on said top surface and an elongated through slot extending along said blade longitudinal axis, said top and bottom surfaces and said side walls substantially defining a rectangle in transverse cross section;

an elongated cross member having a longitudinal axis, top and bottom surfaces, linear and angle measurement indicia on said top surface and a notch in said top surface, said notch having two opposed substantially planar side surfaces, said side surfaces being spaced apart approximately the distance between said blade side walls, said notch receiving said blade for orienting said longitudinal axes perpendicularly, preventing relative angular movement and permitting said cross member to slide along said blade longitudinal axis, said blade being removable from said notch by a separating relative movement of said blade and cross member in a direction perpendicular to said longitudinal axes for permitting angular adjustment therebetween;

a land located in said notch between said side surfaces, said land having substantially planar side walls extending generally parallel to said side surfaces, said land and slot having substantially equal widths, said land being receivable in said slot;

a threaded member coupled to said cross member in said notch and extending perpendicularly from said cross member top surface through said blade slot; and a knob coupled to said threaded member and movable relative to said blade and cross member for forcing said blade against said cross member such that relative longitudinal and angular positions of said blade member and cross member can be adjusted and secured without complete disengagement of said blade, said cross member, said threaded member and said knob.

2. An adjustable T-square according to claim 1 wherein said land and said side surfaces extend perpendicularly to said cross member longitudinal axis for substantially equal lengths.

3. An adjustable T-square according to claim 1 wherein said threaded member comprises an externally threaded rod fixed to said cross member; and said knob is internally threaded.

4. An adjustable T-square according to claim 1 wherein said blade has a recess opening on a bottom surface thereof and adjacent one end thereof for receiving said land.

5. An adjustable T-square according to claim 1 wherein said land has dimensions, in directions transverse to said threaded member, greater than said threaded member.

* * * * *